US005806603A

United States Patent [19]

Schaefers et al.

[11] Patent Number: 5,806,603

[45] Date of Patent: Sep. 15, 1998

[54] FIRE EXTINGUISHING DEVICE

[75] Inventors: Herbert Schaefers, Overath, Germany; John S. Nicholas, Menominee, Mich.

[73] Assignee: Total Walther Feuerschutz GmbH, Cologne, Germany

[21] Appl. No.: 635,768

[22] Filed: Apr. 22, 1996

[30] Foreign Application Priority Data

Apr. 20, 1995 [DE] Germany ..... 195 14 532.1

[51] Int. Cl.[6] ..... A62C 5/00

[52] U.S. Cl. ..... 169/12; 169/26

[58] Field of Search ..... 169/12, 28, 35, 169/26, 84

[56] References Cited

U.S. PATENT DOCUMENTS

| | | | |
|---|---|---|---|
| 744,061 | 11/1903 | Fry | 169/28 |
| 832,269 | 10/1906 | Myers | 169/35 |
| 1,149,975 | 8/1915 | Cole | 169/28 |
| 1,233,289 | 7/1917 | Thomson | 169/26 |
| 2,719,589 | 10/1955 | Mapes | 169/28 X |
| 5,305,957 | 4/1994 | Szocs | 239/302 |
| 5,441,114 | 8/1995 | Spector et al. | 169/12 X |

FOREIGN PATENT DOCUMENTS

| | | |
|---|---|---|
| 560095 | 9/1993 | European Pat. Off. . |
| 569025 | 11/1993 | European Pat. Off. . |
| 578843 | 1/1994 | European Pat. Off. . |

OTHER PUBLICATIONS

Oskar Kausch, "Das chemische Feuerlöschwesen", Verlag von S. Hirzel, Leipzig, 1939, p. 19.

*Primary Examiner*—Andrew C. Pike
*Attorney, Agent, or Firm*—Horst M. Kasper

[57] ABSTRACT

A fire-extinguishing device is furnished, wherein an aerosol is generated in a single container or in a plurality of containers by burning a solid extinguishing agent. The aerosol streams and flows into the area to be protected along a nondirect path through annular channels or directly through a sieve floor.

12 Claims, 2 Drawing Sheets

FIRE EXTINGUISHING DEVICE

BACKGROUND OF THE INVENTION

1. Field of the Invention

The invention relates to a fire extinguishing device comprising a container filled with a solid fire-extinguishing agent, wherein the fire extinguishing agent generates a finely dispersed fire-extinguishing aerosol by way of controlled ignition based on burning inside the container, wherein the finely dispersed fire-extinguishing aerosol is applied by escaping from the container into a spatially defined area or an area defined by a project.

2. Brief Description of the Background of the Invention Including Prior Art

Fire extinguishing agents forming aerosols are known from European Patent document EP 0,560,095 A1 and are subject to control by governmental authorities. A fire-extinguishing method is also known from the European Patent document EP 0,578,843 A1, where the aerosol generator is placed as a mobile unit into the areas to be protected. In addition, an automatic fire-extinguishing system is described in the European Patent document EP 0,569,025 A2, wherein the aerosol generator is employed as a mobile unit.

The known devices are associated with the disadvantage that the fire-extinguishing aerosol can exit freely from the aerosol generator and thus cannot be employed in a controlled manner for fighting of a fire.

SUMMARY OF THE INVENTION

1. Purposes of the Invention

It is an object of the present invention to provide a device, wherein the aerosols are generated by burning and can be employed in a stationary plant, wherein the mixing of the aerosol with the ambient air is improved.

It is another object to provide a fire-extinguishing device, wherein a compact and self-contained structure furnishes the functions of triggering, ignition, and release of an extinguishing agent.

It is yet a further object to furnish a fire-extinguishing device, wherein the fire-extinguishing agent is released in the immediate neighborhood of a fire-detecting element.

These and other objects of and advantages of the present invention will become evident from the description which follows.

2. Brief Description of the Invention

The present invention provides for a fire-extinguishing device. A container is filled with a solid extinguishing agent. A mechanical igniter is disposed inside of the container adjacent to the solid extinguishing agent for furnishing an automatically operating fire-extinguishing device. An activator is connected to the mechanical igniter for triggering the mechanical igniter. A controlled ignition is followed by burning the solid extinguishing agent inside the container. The solid extinguishing agent generates a finely dispersed fire-extinguishing aerosol. The fire-extinguishing aerosol, escaping from the container, is employable in a spatially defined or project-defined area for fire extinguishing.

A triggering device can be connected to the mechanical igniter and to the activator. The mechanical igniter can protrude into the solid extinguishing agent. The triggering device can trigger the mechanical igniter by exerting a pulling force onto the mechanical igniter.

A support element can be attached to the container and be engaged by the activator. A pretensioned spring can be connected to actuate the support element.

A downwardly open pot-shaped chamber can have a floor and surround the container, wherein the container is upwardly open. The pot-shaped chamber can be disposed inside of a spatially fixed, upwardly open vessel. The pot-shaped chamber can be connected to the spatially fixed vessel. A support element can be connected to a floor of the container and connected to the activator disposed below the vessel. A ripping cord can be connected to the mechanical igniter. The ripping cord can function as a triggering device and can be attached to the floor of the pot-shaped chamber.

A seal can be disposed along an upper edge of the container. A vessel can surround the container. A screw socket can have an inner thread and be attached to a bottom of the vessel. A screw neck can have an outer thread and be associated with the activator. The upper edge of the container can be pressed against a floor of the pot-shaped chamber by screwing the screw neck of the activator with its outer thread into the inner thread of the screw socket.

A pot-shaped chamber can be disposed between the vessel and the container. The container can form with the pot-shaped chamber a downwardly open, inner annular channel. The pot-shaped chamber can form with the vessel an upwardly open, outer annular channel. The outer annular channel exhibits a smaller cross section relative to a cross section of the inner annular channel.

A suspension device can be disposed between the vessel and a wall structure. The vessel can be attached to the wall structure by way of the suspension device.

A movable intermediate floor can be disposed at a distance relative to and below of a spatially fixed ceiling. The container furnished with a perforated floor can be suspended from the movable intermediate floor. A sleeve can be attached to the spatially fixed ceiling, wherein the intermediate floor is supported by the sleeve. A driving tenon can be attached to the movable intermediate floor. A support element can be connected to the activator and to the driving tenon. A pretensioned spring can be furnished between the spatially fixed ceiling and the movable intermediate floor. A triggering device for the mechanical igniter and connected with a suspension device can be attached to the ceiling.

The sleeve can be furnished with openings for receiving the driving tenon supporting the intermediate floor. A support element can be connected to the activator and include a support body with a guide pin in an area of the openings of the sleeve for supporting the driving tenon.

The pretensioned spring can surround the sleeve in an area above the intermediate floor.

The container can be connected to the intermediate floor by way of clamping rings.

A plurality of containers can be disposed at the intermediate floor and around the sleeve.

The containers and the sleeve can be surrounded by a protective basket, wherein the protective basket can be attached at the intermediate floor.

The protective basket can be furnished by a sieve netting.

The present invention provides for the container which is furnished with a mechanical igniter for an automatically operating fire-extinguishing device, wherein the igniter is triggered by an activator. The igniter, protruding into the solid extinguishing agent, is furnished with a triggering device, wherein the triggering device triggers or trips the igniter by way of a pulling and tensioning force.

Based on this step, the aerosol-generating container can be furnished as an individual container or in a group of several containers within an area to be protected and is associated with the conventional advantages of aerosol fire-extinguishing systems. The container or the containers can be disposed such that the aerosol formed can be employed in a controlled way and can be directed to the immediate neighborhood of the fire-detecting element.

An upwardly open, individual container for holding a fire-extinguishing precursor is surrounded on the outside by a downwardly open pot-shaped chamber, wherein the pot-shaped chamber is disposed inside of an upwardly open vessel, and wherein the pot-shaped chamber is spatially fixedly supported inside the upwardly open vessel. The floor of the container is connected through a support element to an activator attached to an outside of the vessel, and wherein the igniter is connected to a ripping cord attached to the floor of the pot-shaped chamber. The container, the pot-shaped chamber, and the vessel are inserted into each other such that an inner annular channel is formed between the container and the pot-shaped chamber and that an outer annular channel is formed between the pot-shaped chamber and the vessel, wherein the fire-extinguishing aerosol has to escape first through the inner annular channel and then through the outer annular channel. This step and feature increases the flow speed of the aerosol such that the pressure, generated during formation of the aerosol, is sufficient for driving the aerosol out and for intermixing the aerosol with the ambient air.

In connection with the employment of several containers filled with fire-extinguishing agent, it is provided that each one of the containers is connected to a sieve plate and is suspended from a movable intermediate floor and is located at a defined distance below a spatially fixed ceiling. The several containers are surrounded by the sieve plate. The intermediate floor is supported at a sleeve with a driving tenon, coordinated to the sleeve, and an activator held by a support element. A pretensioned spring is furnished between the ceiling and the movable intermediate floor. The triggering device for the igniter is connected to a suspension string attached to the ceiling. Again in this case, the mechanical igniter is triggered by a pulling and tensioning force. The advantage of this arrangement comprises that, upon employment of a single activator, one or several containers are simultaneously applied for generating a fire-extinguishing aerosol.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
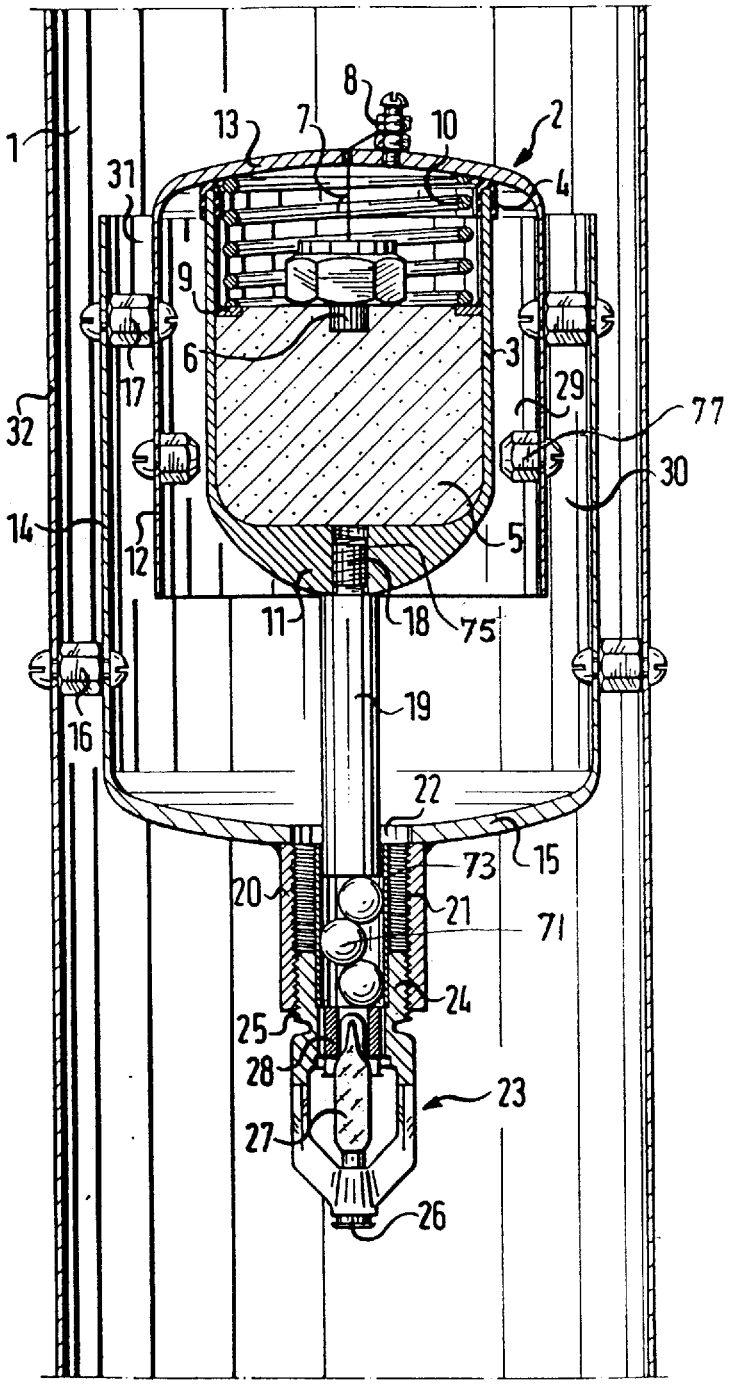
FIG. 1 is a sectional view of a fire-extinguishing device with a single container.

The present invention provides for a fire-extinguishing device. A container is filled with a solid extinguishing agent. The extinguishing agent generates a finely dispersed fire-extinguishing aerosol upon a controlled ignition followed by burning inside the container. The aerosol, escaping from the container, is employable in a spatially defined or project-defined area. The container 3, 50 is furnished with a mechanical igniter 6, 56 for an automatically operating fire-extinguishing device 2. The mechanical igniter 6, 56 is triggerable with an activator 23, 43.

A spatially-defined or project-defined area in the context of the present invention is an area to be protected against fire by means of the invention device. The mechanical igniter 6, 56, protruding into the solid extinguishing agent 5, 51, can be furnished with a triggering device 7, 57. The triggering device 7, 57 can trigger the mechanical igniter 6, 56 by exerting a pulling force. A support element 19, 42 can be furnished between the container 3, 50 and the activator 23, 43. A pretensioned spring 10, 49 can be coordinated to the support element 19, 42.

The container 3 can be upwardly open and can be surrounded by a downwardly open pot-shaped chamber 12. The pot-shaped chamber 12 can be disposed inside of a spatially fixed, upwardly open vessel 14. The pot-shaped chamber 12 can be connected to the spatially fixed vessel 14. A floor 11 of the container 3 can be connected to the activator 23 attached below the vessel 14 through the support element 19. The mechanical igniter 6 can be connected with a ripping cord 7, operating as a triggering device, and be attached to a floor 13 of the pot-shaped chamber 12. An upper edge of the container 3 can be furnished with a seal 4. The upper edge of the container 3 can be pressed against the floor 13 of the pot-shaped chamber 12 by screwing a screw neck 24 of the activator 23 with its outer thread 25 into an inner thread 21 of a screw socket 20.

The container 3 can form with the pot-shaped chamber 12 a downwardly open, inner annular channel 29, and the pot-shaped chamber 12 can form with the vessel 14 an upwardly open, outer annular channel 30. The outer annular channel 30 can exhibit a smaller cross section relative to a cross section of the inner annular channel 29. A floor 15 of the vessel 14 can be furnished with the screw socket 20. The activator 23 connected to the support element 19 can be screwed into the screw socket 20. The vessel 14 can be attached to a wall 32 by way of suspensions 16.

The container 50 furnished with a sieve floor can be suspended from a movable intermediate floor 34 at a distance relative to and below of a spatially fixed ceiling 33. The intermediate floor 34 can be supported by a sleeve 36, attached to the ceiling 33, with coordinated driving tenons 39 and the activator 43 with a support element 42. A pretensioned spring 49 can be furnished between the spatially fixed ceiling 33 and the movable intermediate floor 34. A triggering device 57 for the mechanical igniter 56 can be connected with a suspension device 58 attached to the ceiling 33. The sleeve 36 can be furnished with openings 37, 38 for receiving the driving tenon 39, supporting the intermediate floor 34. The support element 42, connected to the activator 43, can exhibit a support body 40 with a guide pin 41 in the area of the openings 37, 38 for supporting the driving tenon 39. The spring 49 can surround the sleeve 36 in an area above the intermediate floor 34. The container 50 can be connected to the intermediate floor 34 by way of clamping rings 54.

Several containers 50 can be disposed at the intermediate floor 34 and around the sleeve 36. The containers 50 and the sleeve 36 can be surrounded by a protective basket 59. The protective basket 59 can be attached at the intermediate floor 34. The protective basket 59 can be furnished by sieve netting.

A fire-extinguishing device 2 is attached to a wall 32 inside of a space 1 to be protected against fire, as shown in FIG. 1. An upwardly open container 3, having a cylindrical wall section, is filled with a fire-extinguishing agent or a precursor of a fire-extinguishing agent 5 forming an aerosol upon being ignited. An upper edge of the container 3 is furnished with an annular seal 4, and a downwardly open pot-shaped chamber 12 is placed with the floor 13 of the pot-shaped chamber 12 onto the annular seal 4. A mechanical igniter 6 protrudes into the extinguishing agent 5, wherein the mechanical igniter 6 is ignited by a ripping cord 7 based on a pulling force or a tensioning force. The ripping cord 7 is connected to an attachments 8 furnished at the floor 13 of the pot-shaped chamber 12.

Such a mechanical igniter is disclosed in the European Patent document 0,569,025-A2. The igniter is an element known per se and the ignition effect can be compared to a head of a match striking on a striking surface of a match box. According to the present invention, a striking surface is provided within the igniter, where the striking surface is coordinated to the ignition body (head of a match), connected to the ignition cord (match body). The tension of the spring is released after opening the sprinkler in the case of a fire such that the ignition body passes along the striking surface and thereby causes the ignition.

A support ring 9 is disposed inside the container 3, and a spring 10 rests on the support ring 9, wherein the spring 10 on the other hand presses against the inner side of the floor 13. The support ring 9 forms an inner collar of the container 3. The support ring 9 is located in about a second fifth of the inner height of the container as measured from the top of the container 3. The support ring 9 can protrude from about 0.05 to 0.2 and preferably from about 0.08 to 0.15 of the inner diameter of the container 3 from the inner side wall of the container 3. A support element 19 is connected to the floor 11 of the container 3. The floor 11 of the container is provided with a threaded hole 75 centered relative to the axis of the cylindrical section of the container 3. The floor of the container is preferably provided with an increased thickness in comparison to the walls of the container and can have a thickness of from about 3 to 10 times and preferably 5 to 8 times the wall thickness of the cylindrical section of the container 3. The support element 19 is attached to an outer side of the floor of the container 3. The length of the container 3 in axial direction can be from about 1.4 to 1.6 times the length of the support element 19 as measured from the outer side of the floor 11 of the container 3. The outer diameter of the cylindrical section of the container 3 can be from about 4 to 5 times the outer diameter of the support element 19. The support element 19 can be a cylindrical bar aligned with its axis to a center axis of the container 3 and disposed below the container 3. The support element 19 has an upper extension 18 with an outer thread to fit the threaded hole 75 and to solidly attach the support element 19 to the floor 11 of the container 3. The increased thickness of the floor 11 of the container 3 around the threaded hole 75 furnishes a stable axial alignment between the container 3 and the support element 19.

The pot-shaped chamber 12 is surrounded by an upwardly open vessel 14, wherein the pot-shaped chamber 12 and the vessel 14 are connected to each other by attachment means 17. The pot-shaped chamber 12 preferably includes a cylindrical wall section, and the vessel 14 includes preferably a cylindrical wall section. The thickness of the floor 13 of the pot-shaped chamber 12 can be from about 2 to 4 times the thickness of the cylindrical wall section of the pot-shaped chamber 12. The thickness of the floor 15 of the vessel 14 can be from about 2 to 4 times the thickness of the cylindrical wall section of the vessel 14. The cylindrical wall section of the container 3, the cylindrical wall section of the pot-shaped chamber 12, and the cylindrical wall section of the vessel 14 are preferably aligned to the same symmetry axis. The diameter of the cylindrical wall section of the pot-shaped chamber 12 can be from about 1.3 to 1.6 times the diameter of the cylindrical wall section of the container 3. The diameter of the cylindrical wall section of the vessel 14 can be from about 1.1 to 1.4 times the diameter of the cylindrical wall section of the pot-shaped chamber 12. The overall axial length of the pot-shaped chamber 12 can be from about 1 to 1.1 times the length of the container 3 and is preferably provided such that when the annular seal 4 rests against the floor 13 of the pot-shaped chamber 12, then the outer bottom of the container 3 is flush with the edge and the rim of the open side of the pot-shaped chamber 12, which would provide the relative rest position of the container 3 and of the pot-shaped chamber 12. The axial length of the vessel 14 can be from about 1.3 to 1.6 times the axial length of the pot-shaped chamber 12 and is preferably from about 1.4 to 1.5 times the axial length of the pot-shaped chamber 12.

The attachment means 17 can be furnished by screw connections, by welded webs, or by friction connections. In particular, the attachment means 17 can be provided by screw connections passing through the cylindrical wall sections of the vessel 14 and of the pot-shaped chamber 12 and employing appropriate distance spacers. The cylindrical wall section of the vessel 14 is again solidly connected to a wall 32 with suspensions 16 or attachment means. The suspensions 16 can include screws passing through perforation holes in the walls of the vessel 14 and/or of the wall 32.

The suspensions 16 and the attachment means 17 are distance spacers in order to form, among other things, the annular channels 29 and 30. The floor 15 of the vessel 14 is furnished with an opening 22, where the opening 22 is preferably round and defined by a round edge of the floor of the vessel 14 and disposed symmetrically relative to the axis of the vessel, wherein a screw socket 20 is welded to the opening 22, and wherein the axis of the screw socket 20 is aligned with the center of the opening 22. The screw socket 20 is furnished with an inner thread 21. A screw neck 24 of an activator 23 is screwed with its outer thread 25 into the inner thread 21 of the screw socket 20. A glass barrel or a small glass cask 27 for disintegration in case of thermal load and held with a cap 28 is inserted into a support body 26 of the activator 23. The cap 28 is movable relative to the screw neck when a disintegration or collapsing of the small glass cask 27 occurs. The activator 23 together with the support element 19 is constructed such that the container 3 presses with the spring 10 against the floor 13 of the pot-shaped chamber 12, whereby the spring 10 is pretensioned. Thus, the activator 23, the support element 19, the container 3, the spring 10, and the pot-shaped chamber 12 are all aligned substantially to the same axis. The container 3, the pot-shaped chamber 12, and the vessel 14 are arranged such that an inner annular channel 29 and an outer annular channel 30 are formed. Several balls 71 are furnished between the activator 23 and the support element 19 and in particular between the cap 28 and the support element 19 in a guidance tube 73 attached to the screw neck 24 for increasing the stroke. The guidance tube 73 extends from about the upper end of the rest position of the cap 28 to about the level of the lower end of the vessel 14 in the opening 22. The balls 71 are thus capable of following a motion performed by the cap 28. The guidance tube 73 matches with its inner diameter substantially the outer diameter of the support element 19.

The balls 71 are provided to enlarge the stroke path of the support element 19. The balls 71 are provided to vary the path of the ignition head along the striking surface. If the support element 19 would be lengthened, then the support element would come to rest on the cap 28 of the activator 23 and would thereby not form a variable stroke path. The balls 71 can however escape and exit from the sprinkler casing on the side and can thereby enlarge the effective stroke path of the support element.

Spacer elements 77 are mounted to the inside of the cylindrical section of the pot-shaped chamber 12 for allowing easy alignment of the container 3 and for preventing the container 3 from assuming canted positions, where the support element 19 would no longer be free to move inside the guidance tube 73.

The mode of operation of this fire-extinguishing device is as follows.

In case of a fire, the activator 23 opens when the glass barrel or the small glass cask 27 breaks or explodes, whereby the force of the spring 10 is released and becomes effective. This induces the container 3 to press in a downward direction and, consequently, the ripping cord 7 pulls and the igniter 6 is tripped by the ripping cord 7 and ignites. The solid extinguishing agent 5 burns inside the container 3 and generates a fire-extinguishing aerosol, which flows initially through the inner annular channel 29 downwardly, and then through the outer annular channel 30 upwardly, and then escapes through the exit cross section 31 into the space 1 to be protected and thereby becomes effective for fire extinguishing.

Figure 2:
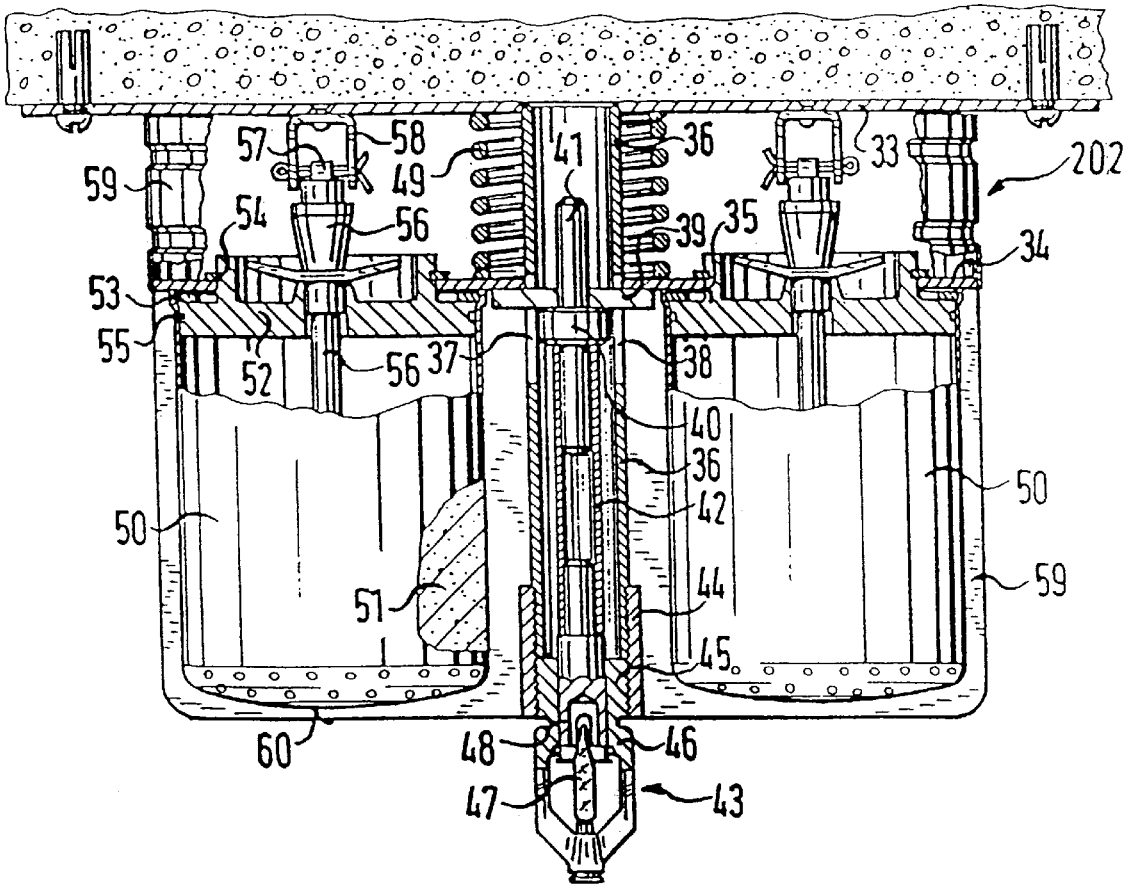
FIG. 2 is a sectional view of a fire-extinguishing device with a plurality of containers.

A fire-extinguishing device 202 with several containers 50 is shown in FIG. 2. The solid, aerosol-forming extinguishing agent 51 is disposed in a plurality of containers 50. One or several of these containers can be placed in such an arrangement. In case more than two containers are furnished, these containers are preferably arranged in a circle. The container 50, filled with the solid fire-extinguishing agent 51, is suspended from a spatially fixed ceiling 33. A sleeve 36 is solidly connected at its upper end to the ceiling 33, and the sleeve 36 supports at its lower end an activator 43. A movable intermediate floor 34 having a floor opening 35 is coordinated to the sleeve 36. The movable intermediate floor 34 surrounds the sleeve 36. The movable intermediate floor 34 is supported by a driving tenon 39, wherein the driving tenon 39 rests on a support body 40 with a guide pin 41. The support body 40 in turn is connected to the support element 42 disposed below the support body 40. The driving tenon 39 protrudes beyond the longitudinal openings 37 and 38 made in the sleeve 36 such that the driving tenon 39 can move together with the support element 42 in an axial direction relative to the sleeve 36. A screw socket 44 having an internal thread is screwed to the lower end of the sleeve 36. A screw neck 45 of the activator 43 is screwed into the inner thread of the screw socket 44. A glass barrel or a small glass cask 47 with a cap 48 is furnished inside the activator body 46. The sleeve 36 is surrounded by a spring 49 at a level above the intermediate floor 34, wherein the spring 49 is pressed against the ceiling 33 based on the disposition of the activator 43, and the spring 49 is thereby pretensioned. The vessel 50 is furnished with a special floor 52, wherein the special floor 52 connects the intermediate floor 34 to the vessel 50 by way of clamping rings 53 and 54. Furthermore, an annular seal 55 is furnished between the floor 52 and the inner wall of the vessel 50. A mechanical igniter 56 is connected to the floor 52, wherein the igniter 56 protrudes into the solid fire-extinguishing agent 51. The igniter 56 is connected at its upper end to a triggering device 57, wherein the triggering device 57 is suspended from and attached to a suspension device 58 solidly connected to the ceiling 33. The floor 60 of the pot 50 is formed as a sieve floor. Two containers 50 are surrounded by a support basket 59 according to the embodiment of FIG. 2, wherein the support basket 59 is made of screen or sieve netting or exhibits the texture of a strainer.

The mode of operation of the fire extinguisher with multiple pots is as follows.

The activator 43 opens in case of fire, when the small glass cask 47 breaks or explodes caused by the associated thermal load on the glass cask 47. The support element 42 is no longer supported by the glass barrel or small glass cask 47 and the force of the spring 49 becomes thereby effective. The force of the spring 49 presses the intermediate floor 34 together with all parts attached to the intermediate floor 34 downwardly, whereby the triggering device 57 of the igniter 56 is activated. Now, the solid fire-extinguishing agent 51 burns. The thereby formed fire-extinguishing aerosol escapes through the openings of the perforated floor. 60 and can enter stream into the space and area to be extinguished through the mesh floor or strainer texture of the support basket 59.

It will be understood that each of the elements, or two or more together, may find a useful application in other types of extinguishing devices, differing from the types described above.

While the invention has been illustrated and described as embodied in the context of a fire extinguishing device, it is not intended to be limited to the detail shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A fire-extinguishing device comprising a container filled with a solid extinguishing agent;

a mechanical igniter disposed inside of the container adjacent to the solid extinguishing agent;

an activator connected to the mechanical igniter for triggering the mechanical igniter, wherein a controlled ignition is followed by burning the solid extinguishing agent inside the container, wherein the solid extinguishing agent generates a finely dispersed fire-extinguishing aerosol, and wherein the fire-extinguishing aerosol, escaping from the container, is employable in an area for fire extinguishing;

attachment means supporting the container, the mechanical igniter, and the activator for attaching the fire-extinguishing device to a spatially fixed ceiling;

a movable intermediate floor disposed at a distance relative to and below of the spatially fixed ceiling, wherein the container furnished with a perforated floor is suspended from the movable intermediate floor;

a sleeve attached to the spatially fixed ceiling, wherein the intermediate floor is supported by the sleeve;

a driving tenon supporting the movable intermediate floor;

a support element connected to the activator and to the driving tenon;

a pretensioned spring furnished between the spatially fixed ceiling and the movable intermediate floor; and a triggering device for the mechanical igniter and connected with a suspension device attached to the spatially fixed ceiling.

2. The fire-extinguishing device according to claim 1, wherein the sleeve is furnished with openings for receiving the driving tenon supporting the intermediate floor, and wherein the support element connected to the activator includes a support body with a guide pin in an area of the openings of the sleeve for supporting the driving tenon.

3. The fire-extinguishing device according to claim 1, wherein the pretensioned spring surrounds the sleeve in an area above the intermediate floor.

4. The fire-extinguishing device according to claim 1 further comprising clamping rings, wherein the container is connected to the intermediate floor by way of said clamping rings.

5. The fire-extinguishing device according to claim 1, wherein a plurality of said containers is disposed at the intermediate floor and around the sleeve.

6. The fire-extinguishing device according to claim 5, further comprising a protective basket, wherein the containers and the sleeve are surrounded by the protective basket, and wherein the protective basket is attached at the intermediate floor.

7. The fire-extinguishing device according to claim 6, wherein the protective basket is furnished by a mesh floor.

8. A fire-extinguishing device comprising a container filled with a solid extinguishing agent, wherein the extinguishing agent generates a finely dispersed fire-extinguishing aerosol upon a controlled ignition followed by burning inside the container, wherein the aerosol, escaping from the container, is employable in an area for fire extinguishing, wherein the container (3, 50) is furnished with a mechanical igniter (6, 56), wherein the mechanical igniter (6, 56) is triggerable with an activator (23, 43), wherein the container (50) furnished with a perforated floor is suspended from a movable intermediate floor (34) at a distance relative to and below of a spatially fixed ceiling (33), wherein the intermediate floor (34) is supported by a sleeve (36), attached to the spatially fixed ceiling (33), with a coordinated driving tenon (39) and the activator (43) with a support element (42), and wherein a pretensioned spring (49) is furnished between the spatially fixed ceiling (33) and the movable intermediate floor (34), and wherein a triggering device (57) for the mechanical igniter (56) is connected with a suspension device (58) attached to the spatially fixed ceiling (33);

wherein the sleeve (36) is furnished with openings (37, 38) for receiving the driving tenon (39), supporting the intermediate floor (34), and wherein the support element (42), connected to the activator (43), exhibits a support body (40) with a guide pin (41) in an area of the openings (37, 38) for supporting the driving tenon (39);

wherein the spring (49) surrounds the sleeve (36) in an area above the intermediate floor (34); and wherein the container (50) is connected to the intermediate floor (34) by way of clamping rings (54).

9. The fire-extinguishing device according to claim 8, wherein a plurality of said containers (50) are disposed at the intermediate floor (34) and around the sleeve (36);

wherein the plurality of said containers (50) and the sleeve (36) are surrounded by a protective basket (59), wherein the protective basket (59) is attached at the intermediate floor (34); and wherein the protective basket (59) is furnished by a mesh floor.

10. A fire-extinguishing device, comprising a container filled with a solid extinguishing agent;

a mechanical igniter disposed inside of the container adjacent to the solid extinguishing agent;

an activator connected to the mechanical igniter for triggering the mechanical igniter, wherein a controlled ignition is followed by burning the solid extinguishing agent inside the container, wherein the solid extinguishing agent generates a finely dispersed fire-extinguishing aerosol, and wherein the fire-extinguishing aerosol, escaping from the container, is employable in an area for fire extinguishing; and attachment means supporting the container, the mechanical igniter, and the activator for attaching the fire-extinguishing device to a ceiling, wherein the activator includes a hollow glass element for disintegration under thermal load.

11. The fire-extinguishing device according to claim 10, wherein the activator further includes a support body, and a cap inserted into the support body for holding the hollow glass element.

12. A fire-extinguishing device, comprising a container filled with a solid extinguishing agent;

a mechanical igniter disposed inside of the container adjacent to the solid extinguishing agent;

an activator connected to the mechanical igniter for triggering the mechanical igniter, wherein a controlled ignition is followed by burning the solid extinguishing agent inside the container, wherein the solid extinguishing agent generates a finely dispersed fire-extinguishing aerosol, and wherein the fire-extinguishing aerosol, escaping from the container, is employable in an area for fire extinguishing; and attachment means supporting the container, the mechanical igniter, and the activator for attaching the fire-extinguishing device to a ceiling, wherein the activator includes a support body, a hollow glass element for disintegration under thermal load, and a cap inserted into the support body for holding the hollow glass element.

* * * * *